United States Patent [19]

Gonce et al.

[11] Patent Number: 4,486,904

[45] Date of Patent: Dec. 11, 1984

[54] BELT SECURING MEANS

[75] Inventors: William P. Gonce, Phoenix; Edward S. Bilezikian, Baltimore, both of Md.

[73] Assignee: Londontown Corporation, Eldersburg, Md.

[21] Appl. No.: 473,890

[22] Filed: Mar. 10, 1983

[51] Int. Cl.[3] ..... A41F 9/00

[52] U.S. Cl. ..... 2/312

[58] Field of Search ..... 2/321, 312, 302, 304, 2/218, 338, 339, 325, 93, 97

[56] References Cited

U.S. PATENT DOCUMENTS 2,391,352 12/1945 Schwartz ..... 2/97

*Primary Examiner*—Doris L. Troutman

*Attorney, Agent, or Firm*—Donald J. Fitzpatrick

[57] ABSTRACT

A belt securing means adopted to be used with a belted coats comprising a flexible strip having split arrow head end portions. The flexible strip is inserted into a pair of vertical slots contained in a garment belt and retained therein.

5 Claims, 4 Drawing Figures

FIG. 1
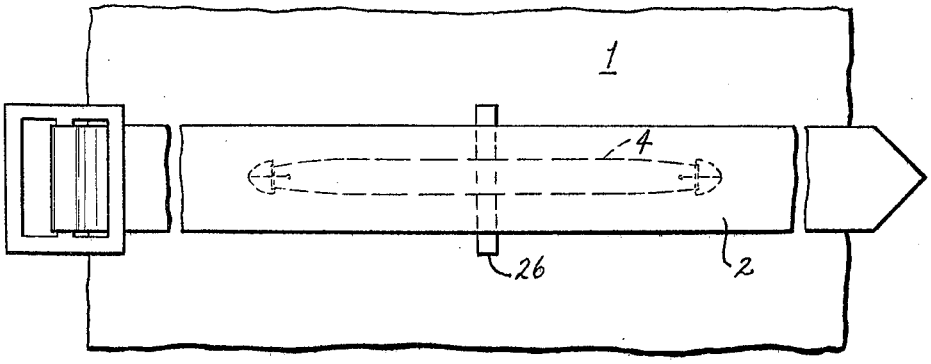
FIG. 2
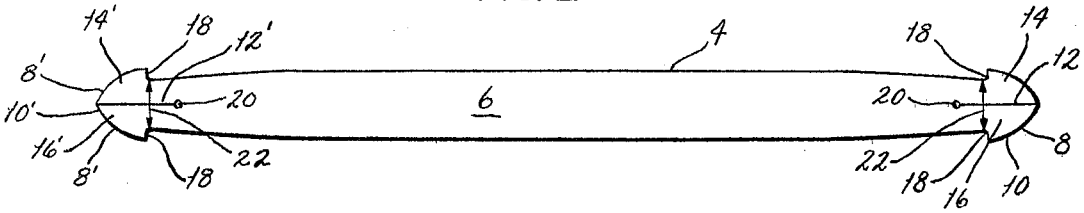
FIG. 3
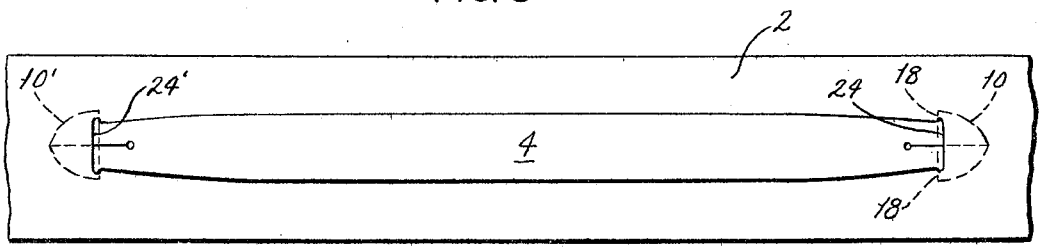
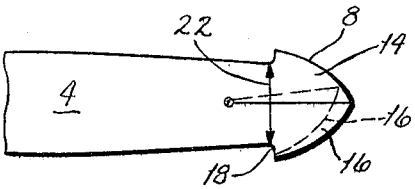
FIG. 4

BELT SECURING MEANS

BACKGROUND OF THE INVENTION

1. Field of the Invention

This invention relates generally to wearing apparel, such as belted coats and jackets and more specifically to a belt and securing means construction used in association with such coats and jackets.

2. Description of the Prior Art

Outerwear such as coats and jackets are commonly supplied with belts that slide in guides or loops for drawing the coat or jacket snugly around the body of the wearer. Retaining means are generally provided to prevent the belt from being detached from the garment. A common practice is by sewing buttons onto the garment and inserting the buttons into the botton holes provided on the belt. Belt retention can also be achieved by placing the buttons onto the belt and locating holes on the garment. The belt is thus buttoned onto the garment whereas in the former construction the garment is buttoned to the belt. Various other retaining means such as snaps, hooks, etc. may also be used.

The retaining means employed by the prior art, particularly buttons and button holes, have presented certain problems. In certain highly tailored and/or fashionable garments the appearance of buttons is a distraction, frequently impairing garment esthetics. In other garments the use of buttons and snaps causes a bulge on the belt. Bulges can likewise detract from a garment's appearance. Fastening buttons and snaps and making button holes on the adjacent garment or belt effects the overall cost of the garment. In order to reduce costs and improve profit margins manufacturers are constantly looking for improved techniques in garment construction while still maintaining good tailoring and fashionable appearance.

SUMMARY OF THE INVENTION

The belt securing means of this invention comprises a flexible strip having split arrow head end portions. The flexible strip is inserted into a pair of vertical slots contained in a garment belt and thereby retained therein.

It is, therefore, an object of this invention to provide a means for securing a belt to a garment.

It is another object of this invention to provide a belt securing means that does not employ buttons or snaps.

Still another object of this invention is to provide securing means for a belt which permits the latter to be readily removed from the garment.

A still further object of this invention is to provide securing means for a belt which is of exceedingly simple and inexpensive construction and which in no way detracts from or changes the appearance of the belt or garment.

These and other objects will become apparent from the description of the invention as hereinafter more fully described.

BRIEF DESCRIPTION OF THE DRAWINGS

FIG. 1 is a further view, in elevation, of a belt secured to a garment showing the belt securing means of this invention in phantom.

FIG. 2 is a plan view of the flexible belt securing means of this invention.

FIG. 3 is a plan view showing the flexible belt securing means positioned onto a garment belt.

FIG. 4 is a view of the arrow head end of the flexible belt securing means in a depressed form prior to insertion into a garment belt.

DESCRIPTION OF THE PREFERRED EMBODIMENT

FIG. 1 shows a segment of a garment 1 having a belt 2. The belt is maintained in a predetermined position on the garment by a series of belt loops 26. For clarity only one loop is shown.

The belt 2 is secured to the garment by belt securing means 4. The construction of the belt securing means can be more easily understood by reference to FIGS. 2, 3 and 4. The securing means 4 comprises a rectangular, flexible strip 6 having tapered split end portions 8 and 8' terminating in arrow head configurations 10 and 10'. Each arrow head is bi-sected by an essentially horizontal slit 12 thus forming each arrow head into an upper segment 14 and lower segment 16. These arrow heads are further provided with curved radius portions 18. The significance of this element 18 will be hereinafter discussed in further detail.

Flexible strip 6 is generally formed from a flexible plastic material such as MYLAR. The melting point of the plastic selected for the securing means of this invention should be high enough to withstand commercial heating and cleaning cycles which garments may normally be subjected to. A characteristic of plastic strips is susceptibility to tearing once a crack or tear is formed. Horizontal slits 12 are essential for the functioning of this invention. In order to prevent these slits from propagating throughout the rectangular strip 6 stress relieving holes 20 are provided at the terminus of each slit.

Referring now to FIG. 3 it is noted that belt 2 contains two essentially vertical slots 24 and 24'. The length of these slots is equal to the width of 22 of the tapered split end portions. The belt securing means is attached to the belt 2 by squeezing together upper segment 14 and lower segment 16. As shown in FIG. 4 this causes the split end portion 8 to decrease in size as the segments are forced to overlap one another, thus enabling insertion into vertical slot 24. The securing means is retained within the slot by curved radius portions 18 abutting the ends of the vertical slot. This mode of retaining the end portion within the slot is analogous to retaining a fish hook or some similar barbed device within its intended object. The securing means can be easily removed from the belt by merely squeezing the split end portion together and pulling the arrow-head out from the vertical slot. Squeezing the split end portion acts to disengage the curved radius portion 18 from the slot ends. By providing a slot length equal to the tapered width of the securing means a tight fit between belt 2 and flexible strip 6 is achieved.

Belt 2 is secured to a jacket or coat 1 in the following manner: The garment is provided with a series of belt loops 26 and a belt is placed in correct relationship with the garment. One end of securing means 4 is inserted into slot 24 of the belt by squeezing together split end portion 8 and releasing the squeezing action after the curved radius engages the slot thereby retaining the end portion within the slot. The securing means is pushed through the under side of belt loop 26 adjacent to the garment and inserted into the other slot 24' of the belt in a similar manner. The belt is now secured to the garment. The securing means is removed from the belt by disengaging the split end portion by squeezing the end portion retained within the belt together and withdrawing it from the slot. The other end is then removed in like manner.

Various modifications of the invention, in addition to those shown and described herein, will become apparent to those skilled in the art from the foregoing description. Such modifications are intended to fall within the scope of the appended claims.

We claim:

1. A belt securing means comprising:

a belt having a pair of vertical slots; and a flexible strip having tapered split end portions terminting into arrow heads, said end portions further having a curved radius portion adapted to engage said vertical slots thus retaining said means onto said belt.

2. The belt securing means of claim 1 further comprising a stress relieving means spaced from the end of said arrow head and at the terminus of said split end portion.

3. A belt securing means comprising:

a belt having a pair of vertical slots; and a flexible strip having tapered split end portions, a horizontal slit at each said end defining an upper segment and a lower segment, a curved radius portion so that said upper and said lower segments can be squeezed together thereby enabling said tapered end portions to be inserted into said vertical slots.

4. The belt securing means of claim 3 further comprising a stress relieving means at the terminus of said split end portion.

5. The belt securing means of claim 3 wherein the width of said tapered split end portion is essentially equal to the length of said vertical slot.

* * * * *